US005101908A

United States Patent [19]

Mody

[11] Patent Number: 5,101,908

[45] Date of Patent: Apr. 7, 1992

[54] INFLATABLE PACKING DEVICE AND METHOD OF SEALING

[75] Inventor: Rustom K. Mody, Houston, Tex.

[73] Assignee: Baker Hughes Incorporated, Houston, Tex.

[21] Appl. No.: 572,213

[22] Filed: Aug. 23, 1990

[51] Int. Cl.[5] ..... E21B 33/127; E21B 33/129

[52] U.S. Cl. ..... 166/387; 166/120; 166/187; 166/191

[58] Field of Search ..... 166/378, 387, 120, 122, 166/127, 187, 191

[56] References Cited

U.S. PATENT DOCUMENTS

| | | | |
|---|---|---|---|
| 2,991,833 | 7/1961 | Brown et al. . | |
| 3,524,503 | 8/1970 | Baker . | |
| 3,529,667 | 9/1970 | Malone . | |
| 3,542,127 | 11/1970 | Malone . | |
| 4,349,204 | 9/1982 | Malone . | |
| 4,424,861 | 1/1984 | Carter, Jr. et al. | 166/120 |
| 4,768,590 | 9/1988 | Sanford et al. | 166/187 |
| 4,781,249 | 11/1988 | Wood | 166/187 |
| 4,892,144 | 1/1990 | Coone | 166/122 |
| 4,923,007 | 5/1990 | Sanford et al. | 166/187 |
| 4,967,846 | 11/1990 | Wood | 166/187 |

*Primary Examiner*—Bruce M. Kisliuk
*Attorney, Agent, or Firm*—Melvin A. Hunn

[57] ABSTRACT

An inflatable packing device is provided for use in wellbore containing fluid. The inflatable packing device provides a seal between a conduit carrying the inflatable packing device and an interior surface within the wellbore. A cylindrical housing is provided having a central longitudinal axis, and including upper and lower collar members. A means for securing the cylindrical housing to the conduit is provided. An annular inflatable wall with upper and lower ends is secured to the upper and lower collar members respectively, with the annular inflatable wall disposed over at least a portion of the cylindrical housing. The annular inflatable wall includes an inner elastomeric sleeve covered by an array of movable slats. Upper and lower elastomeric annular covers are disposed over a portion of the annular inflatable wall between the upper and lower collar members of the cylindrical housing. The upper and lower elastomeric annular covers are axially spaced-apart relative to the central longitudinal axis of the cylindrical housing. The elastomeric annular covers in-part define upper and lower anchor regions. A central region of the annular inflatable wall is provided between the first and second elastomeric annular covers. The first and second anchor regions and the central region are outwardly movable from a non-inflated running position to an inflated setting position.

19 Claims, 4 Drawing Sheets

INFLATABLE PACKING DEVICE AND METHOD OF SEALING

BACKGROUND OF THE INVENTION

1. Field of the Invention

This invention relates generally to inflatable packers for use in wellbores, and specifically to inflatable packers, which have an elastomeric cover disposed over an annular inflatable wall.

2. Description of the Prior Art

In the drilling and production of oil and gas wells, it is frequently necessary to isolate one subterranean region from another and prevent the passage of fluids between those regions. Conventional packers and bridge plugs are used as packing devices in wellbores containing fluid for providing a seal between a conduit which carries the device downward in the wellbore and an interior surface within the wellbore, such as casing or an uncased wellbore wall.

One type of double anchor, packing device includes two regions of expandable material which serve to grip the interior surface within the wellbore. Usually, an elastomeric annular cover is provided between the two anchor regions. The elastomeric annular cover also radially expands outward, and eventually engages the desired surface and forms a seal, thus preventing the passage of fluid.

When a packing device having a small diameter is lowered in a wellbore for engaging and forming a seal with a much larger diameter casing, the elastomeric annular cover is subjected to extraordinary multi-dimensional strain, including bi-axial and tri-axial strain, that is, a strain having two or three dimensional components. Consequently, it is possible for the outer flexible cover to split, destroying the utility of the packing device.

"Soft set" is another frequently encountered problem in the prior art devices. Soft set occurs when fluid is trapped between each end of the outer cover of the packing device. When a soft set occurs, the packing device is not as firmly anchored as possible, and may slip or rotate unexpectedly.

SUMMARY OF THE INVENTION

It is one objective of the present invention to provide an inflatable packing device for use in a wellbore in which multi-dimensional strain on the annular elastomeric cover is minimized.

It is another objective of the present invention to provide an inflatable packing device for use in a wellbore which does not trap fluid in the region of the annular elastomeric cover, and thus minimizes the occurrence of a soft-set of the inflatable packing device against the casing or uncased wellbore wall.

These and other objectives are achieved as is now described. An inflatable packing device is provided for use in wellbore containing fluid. The inflatable packing device provides a seal between a conduit carrying the inflatable packing device and an interior surface within the wellbore. A cylindrical housing is provided having a central longitudinal axis, and including upper and lower collar members. Means for securing the cylindrical housing to the conduit is provided. An annular inflatable wall with upper and lower ends is secured to the upper and lower collar members respectively, with the annular inflatable wall disposed over at least a portion of the cylindrical housing. The annular inflatable wall includes an inner elastomeric sleeve covered by an array of movable slats. Upper and lower elastomeric annular covers are disposed over a portion of the annular inflatable wall between the upper and lower collar members of the cylindrical housing. The upper and lower elastomeric annular covers are axially spaced-apart relative to the central longitudinal axis of the cylindrical housing.

Preferably, the elastomeric annular covers in-part define an upper anchor region of the annular inflatable wall between the upper collar and the upper elastomeric annular cover. The elastomeric annular covers further define a lower anchor region of the annular inflatable wall between the lower collar and the lower elastomeric annular cover. However, it is possible in the present invention for the elastomeric covers to define only a single anchor region either above or below the covers. A central region of the annular inflatable wall is provided between the upper and lower elastomeric annular covers. The upper and lower anchor regions and the central region are outwardly movable from a non-inflated running position to an inflated setting position. The first and second anchor regions expand evenly in opposition to the upper and lower elastomeric annular covers and operate to frictionally engage the interior surface to resist longitudinal and rotational movements when in the inflated setting position. The central region operates to evacuate fluid from between the upper and lower elastomeric annular covers when expanded radially outward from the running position to the setting position. The upper and lower elastomeric annular covers operate to sealingly engage the interior surface and provide a double seal to fluid when expanded radially outward from the running position to the setting position.

The above as well as additional objects, features, and advantages of the invention will become apparent in the following detailed description.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
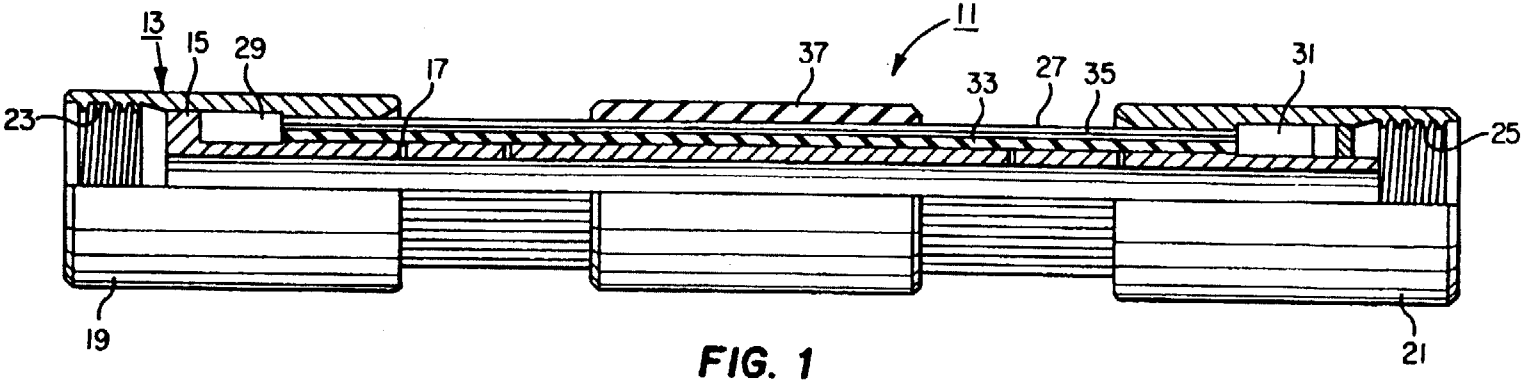
FIG. 1 (PRIOR ART)
FIG. 1 is a simplified and partial longitudinal section of a prior art double anchor packer, in a non-inflated running position.
Figure 2:
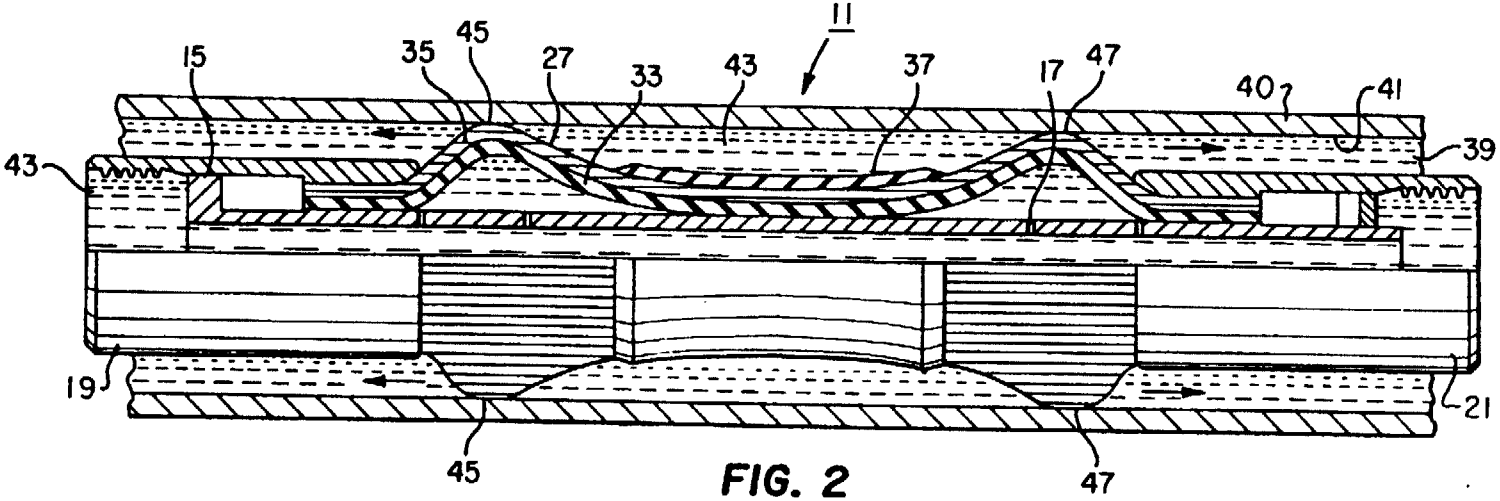
FIG. 2 (PRIOR ART)
FIG. 2 is a simplified partial longitudinal section of the prior art double anchor packer of FIG. 1, disposed within a wellbore, in a semi-inflated condition.
Figure 3:
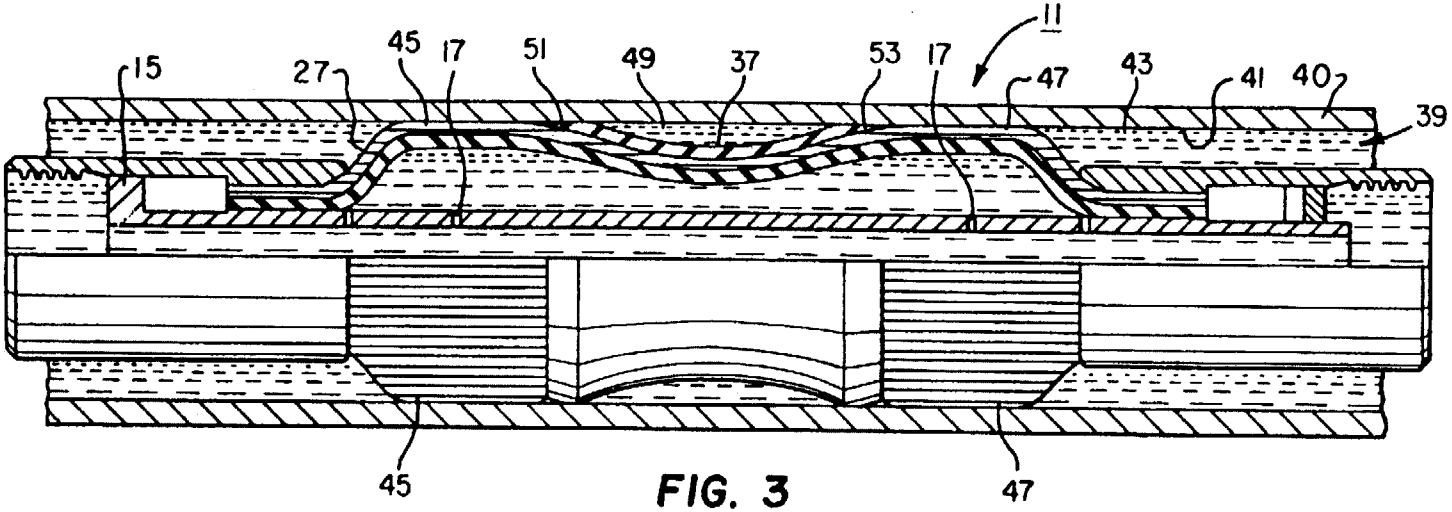
FIG. 3 (PRIOR ART)
FIG. 3 is a simplified partial longitudinal section of the packer of FIGS. 1 and 2, in a wellbore, in a fully-inflated condition, and hence in a setting position.

The present invention is best described and understood with reference first to the prior art double anchor packer of FIGS. 1 through 3. In FIG. 1, the prior art packer is shown in a non-inflated running position. In FIG. 2, the prior art packer is shown in a semi-inflated condition. In FIG. 3, the prior art packer is shown in a fully-inflated running position.

Turning first to FIG. 1, prior art packing device 11 is shown in simplified and partial longitudinal section. The packing device 11 includes cylindrical housing 13 with upper and lower collars 19, 21 attached at each end. Threads 23, 25 are provided in upper and lower collars 19, 21 to allow packing device 11 to be connected to other tubular members in a string. Cylindrical housing 13 includes tubular member 15, with a plurality of ports 17 which allow the passage of fluids to inflate packing device 11.

Annular inflatable wall 27 is disposed over at least a portion of tubular member 15 and is held in place by couplings 29, 31. Annular inflatable wall 27 includes inner elastomeric sleeve 33 and an array of slats 35 which are disposed about the outer surface of inner elastomeric sleeve 33. Cylindrical elastomeric cover 37 is disposed over a central region of annular inflatable wall 27.

As shown in FIG. 2, annular inflatable wall 27 is flexible radially outward from tubular member 15, in response to high pressure fluid which is diverted through ports 17 into the cavity between tubular member and annular inflatable wall 27. In this system, inner elastomeric sleeve 33 operates as a bladder, which expands uniformly in response to increased fluid pressure. Array of slats 35 comprise a plurality of axially aligned and overlapping slats disposed in an annular array for accommodating radial outward expansion of inner elastomeric sleeve 33. Annular inflatable wall 27 is coupled to lower collar 21 in a known manner which allows annular inflatable wall to slide upward and downward as it is inflated and deflated.

Cylindrical elastomeric cover 37 operates to resist outward radial expansion of annular inflatable wall 27 at a mid-region of annular inflatable wall 27 between upper and lower collars 19, 21. Regions of annular inflatable wall 27 above and below cylindrical elastomeric cover 37 will bulge forward to form upper and lower anchor regions 45, 47 which serve to frictionally engage interior surface 41 in wellbore 39.

For purposes of exposition, interior surface 41 is shown as casing; however, packing device 11 may be used in uncased wellbores, and may be used to form a seal with tubular wellbore members other than casing. Upper and lower anchor regions 45, 47 do not serve to form a seal with interior surface 41. Upper and lower anchor regions 45, 47 serve only to inhibit rotational and longitudinal movement of packing device 11 relative to interior surface 41 within wellbore 39. As annular inflatable wall 27 further radially expands, fluid 43 is pushed out of the region between upper and lower anchor regions 45, 47, and will actually flow through the small channels between the individual slats in array of slats 35.

Even in the intermediate semi-inflated position shown in FIG. 2, cylindrical elastomeric cover 37 of packing device 11 is exposed to a rather large multi-dimensional forces, including bi-axial or tri-axial forces. Bi-axial and tri-axial forces are forces which have dimensional components in two or three orthogonally opposed directions. As shown in FIG. 2, cylindrical elastomeric cover 37 is simultaneously pushed radially outward, stretched circumferentially, and tipped upward at its outer ends.

Turning now to FIG. 3, packing device 11 is shown in a fully-inflated setting position with upper and lower anchor regions 45, 47 in frictional engagement with interior surface 41 of wellbore 39 casing. In this configuration, upper and lower ends 51, 53 of cylindrical elastomeric cover 37 sealingly engage interior surface 41. Upper and lower ends 51, 53 of cylindrical elastomeric cover 37 are urged into engagement with interior surface 41 by expansion of upper and lower anchor regions 45, 47. However, the region of annular inflatable wall 27 which underlies cylindrical elastomeric cover 37 expands at a rate which is significantly less than the expansion rate of upper and lower anchor regions 45, 47, due to the added stiffness of cylindrical elastomeric cover 37. Therefore, upper and lower anchor regions 45, 47 serve to fix the location of packing device 11 within wellbore 39, while cylindrical elastomeric cover 37 serves to form a seal with interior surface 41.

Two significant problems exist for packing device 11 when fully inflated. First, as discussed above, cylindrical elastomeric cover 37 is subjected to significant bi-axial or tri-axial strain at upper and lower ends 51, 53. When the strain on cylindrical elastomeric cover 37 exceeds the limits of the elastomer, small longitudinal tears are formed at the ends 51, 53 of cylindrical elastomeric cover 37. Once initiated, these tears propagate rapidly along the length of cylindrical elastomeric cover 37, since elastomers in tension are very susceptible to tears. Once cylindrical elastomeric cover 37 splits, it no longer provides the uniform separation of array of slats 35 as packing device 11 inflates. The uneven expansion of array of slats 35 results in gaps between the slats, which allow inner elastomeric sleeve 33 to extrude through in response to pressure, and eventually erupt. Once inner elastomeric sleeve 33 erupts, packing device 11 looses all pressure, and becomes useless.

Another problem is apparent from the prior art packing device shown in FIG. 3. Since the central region of annular inflatable wall 27 inflates at a rate which is significantly less than the inflation rate of upper and lower anchor regions 45, 47 of annular inflatable wall 27, it is likely that upper and lower ends 51, 53 of cylindrical elastomeric cover 37 will form a seal with interior surface 41 before fluid 43 can be evacuated from between upper and lower ends 51, 53. Consequently, fluid 43 will be trapped between upper and lower ends 51, 53 of cylindrical elastomeric cover 37 and interior surface 41 (in FIG. 3, designated generally as 49). With fluid 49 trapped in this region, the tool has become "soft set." This will effect the overall performance of packing device 11, since it is much more likely to move either longitudinally or rotationally relative to interior surface 41, in an unexpected and unpredictable manner.

If upper and lower ends 51, 53 of cylindrical elastomeric cover 37 form a tight seal with interior surface 41, it is possible for fluid 43 to be trapped between upper and lower ends 51, 53 even though packing device 11 has been inflated to pressures in the range of thousands of pounds per square inch. This is true, since fluid is incompressible. However, it is possible for a low volume leak to occur at the interface of upper and lower ends 51, 53 and interior surface 41, which slowly drains fluid 49 from this region. When this occurs, the pressure of fluid trapped between tubular member 15 and annular inflatable wall 27 will drastically decrease, sometimes to as low as tens or hundreds of pounds per square inch. Of course, when this occurs, packing device 11 will be likely to slide down hole or rotate, under differential pressure or under its own weight. Therefore, a "soft set" is a term which describes a temporary setting of packing device 11 against interior surface 41. The setting will last only for as long as fluid 49 is trapped between upper and lower anchor ends 51, 53 of cylindrical elastomeric cover 37. As discussed above, leakage will eventually result in a depressurization of packing device 11, making it susceptible to slippage or rotation.

Figure 4:
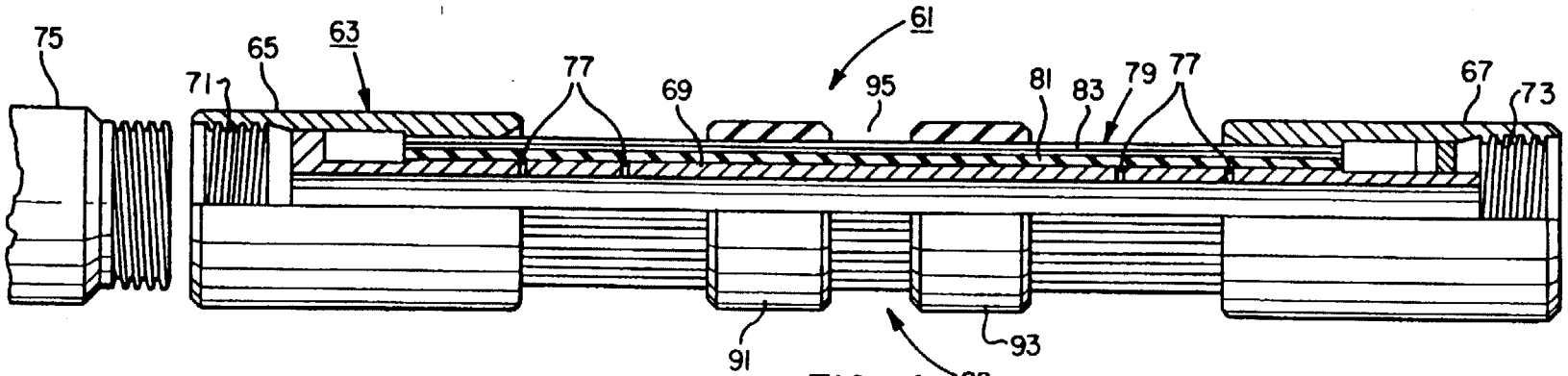
FIG. 4 is a simplified partial longitudinal section of the improved inflatable packing device of the present invention, in a non-inflated running position.
Figure 5:
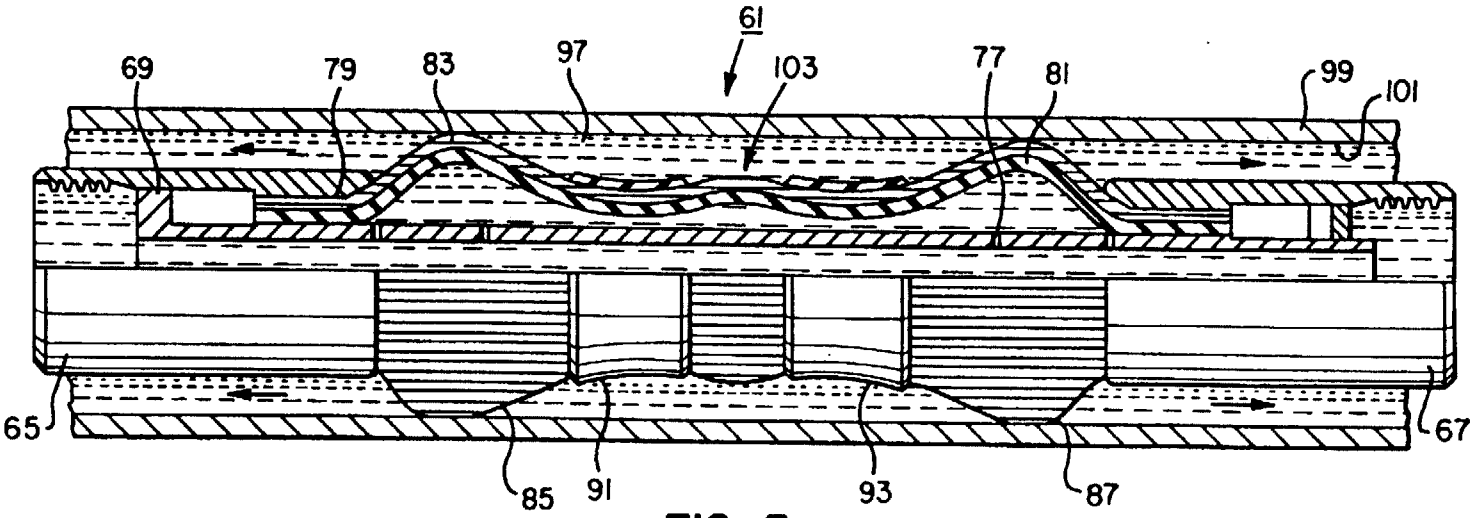
FIG. 5 is a simplified partial longitudinal section of the improved inflatable packing device of FIG. 4, disposed in a wellbore, in a semi-inflated condition.
Figure 6:
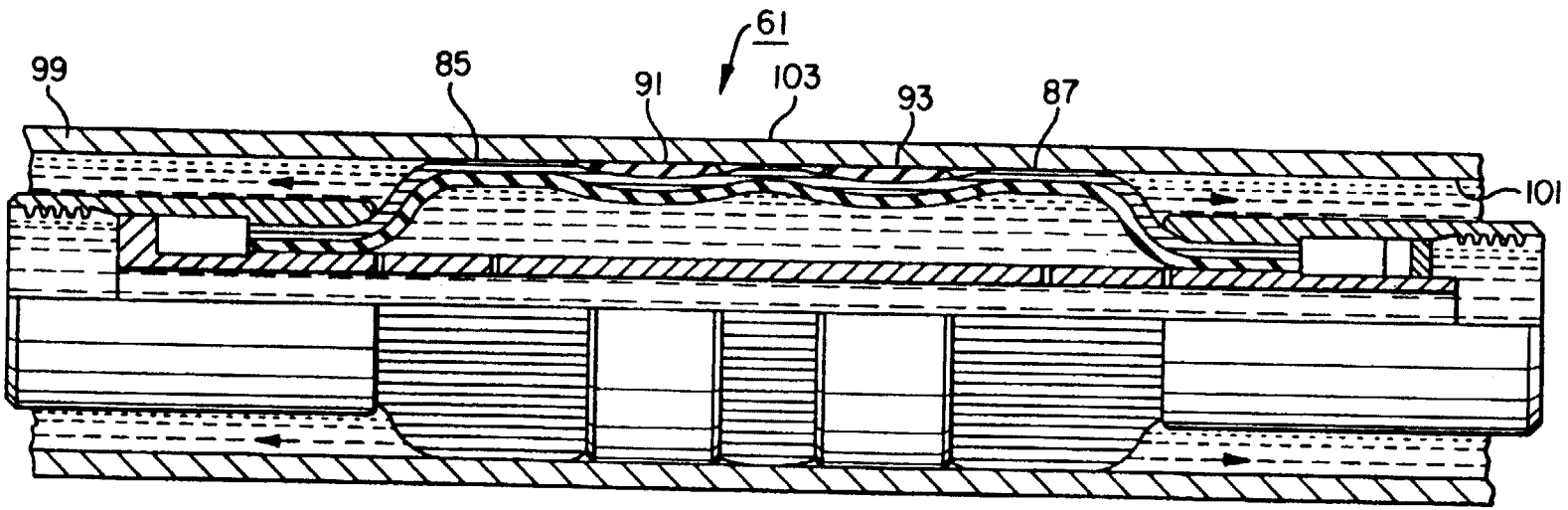
FIG. 6 is a simplified partial longitudinal section of the improved inflatable packing device of FIGS. 4 and 5, disposed in a wellbore, in a fully-inflated setting position.

The improved inflatable packing device 61 of the present invention is shown in FIGS. 4, 5, and 6. FIG. 4 is a view of the improved inflatable packing device 61 in a non-inflated running position. FIG. 5 is a view of the partially-inflated inflatable packing device 61 of the present invention. FIG. 6 is a view of the improved inflatable packing device of the present invention in a fully-inflated setting mode. FIGS. 4 through 6 show the preferred embodiment of the present invention; other embodiments are possible.

Turning first to FIG. 4, inflatable packing device 61 of the present invention is shown in simplified and partial longitudinal section. Inflatable packing device 61 includes cylindrical housing 63 with upper collar 65, lower collar 67, and tubular member 69 extending between upper collar 65 and lower collar 67. Upper and lower collar 65, 67 are threaded at threads 61, 63 and are thus suited for connection in a string of tubular members. Preferably, inflatable packing device 61 is coupled to conduit 75 and lowered in a wellbore. Fluid 97 may be passed down in the wellbore through conduit 75, and may serve to inflate inflatable packing device 61 from the non-inflated running mode shown in FIG. 4 to the fully-inflated setting mode shown in FIG. 6.

Returning now to FIG. 4, tubular member 69 of cylindrical housing 63 includes a plurality of ports 77 which are suited for receiving pressurized fluid from conduit 75, which acts on annular inflatable wall 79 to urge it radially outward. Annular inflatable wall 79 includes inner elastomeric sleeve 81 which is covered by array of slats 83. Preferably, array of slats comprises a plurality of axially aligned and overlapping thin metal slats which are disposed in an annular array for accommodating radial outward expansion of inner elastomeric sleeve 81 in response to fluid pressure.

Cylindrical cover 89 is provided at a mid-region of annular inflatable wall 79, and includes upper and lower elastomeric annular covers 91, 93, with a gap 95 therebetween. Preferably, upper and lower elastomeric annular covers 91, 93 are axially spaced apart along the longitudinal axis of cylindrical housing 63. Preferably, gap 95 between upper and lower elastomeric annular covers 91, 93 serves to fully expose annular inflatable wall 79.

In alternate embodiments, either one of upper or lower elastomeric annular covers 91, 93 may be substantially longer than the other; in fact, one of the elastomeric annular covers 91, 93 may extend all the way up or down to either the upper or lower collars 65, 67. In such embodiments, only a single anchor region is provided on annular inflatable wall 79. In still other embodiments, multiple anchor regions may be provided and defined by a plurality of elastomeric annular covers.

Figure 4A:
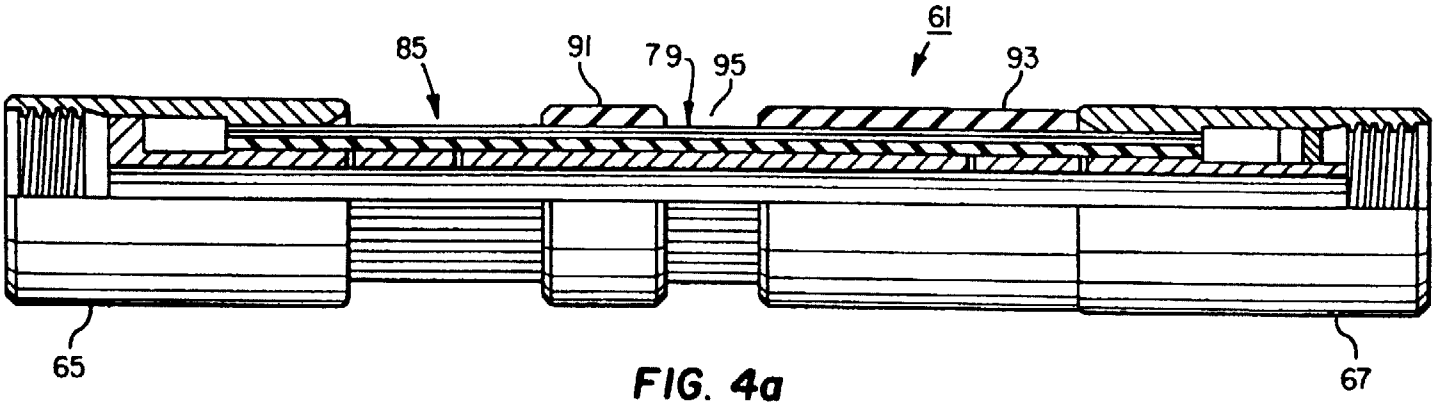
FIG. 4a is a simplified partial longitudinal section of an alternative embodiment of the improved inflatable packing device of the present invention in a non-inflated running position.

FIG. 4a depicts an alternate embodiment of the present invention. In this embodiment, inflatable packing device is provided with only an upper anchor region 85, since lower elastomeric annular cover 93 is substantially longer in length than upper elastomeric cover 91, and extends along the lower portion of annular inflatable wall 79 all the way to lower collar 67. In all other respects, the embodiment of FIG. 4a is similar to the embodiment of FIG. 4, so identical numbers have been used in the drawing.

Turning now to the preferred embodiment of FIG. 5, inflatable packing device 61 is shown in a semi-inflated state. Pressurized fluid causes annular inflatable wall 79 to expand radially outward. The portions of annular inflatable wall 79 which are not covered by upper and lower elastomeric annular covers 91, 93 expand outward into contact with interior surface 101 of casing 99. Upper anchor region 85 is provided between upper elastomeric annular cover 91 and upper collar 65. Lower anchor region is provided between lower elastomeric annular cover 93 and lower collar 67. Upper and lower anchor regions 85, 87 operate to frictionally engage interior surface 101 of casing 99, and "set" inflatable packing device 61. At gap 95 between upper and lower elastomeric annular covers 91, 93, a central area 103 of annular inflatable wall 79 also expands radially outward. Of course, the regions of annular inflatable wall 79 which underlie upper and lower elastomeric annular covers 91, 93 also expand radially outward in response to high pressure fluid.

Of these regions, upper and lower anchor regions 85, 87 expand at the fastest rate. Central area 103 of annular inflatable wall 79, which corresponds to the region of annular inflatable wall 79 which underlies gap 95 between upper and lower elastomeric annular covers 91, 93, expands at a rate which is less than that of upper and lower anchor regions 85, 87. The regions of annular inflatable wall 79 which underlie upper and lower elastomeric annular covers 91, 93 expand at the slowest rate.

Since regions of annular inflatable wall 79 on both sides of upper and lower elastomeric annular covers 91, 93 are radially expanding, the multi-dimensional strain on upper and lower elastomeric annular covers 91, 93 is diminished. As shown in FIGS. 5 and 6 the ends of upper and lower elastomeric annular covers 91, 93 are tipped upward much less than the ends of the prior art covers. Furthermore, as central area 103 of annular inflatable wall 79 expands between upper and lower elastomeric annular covers 91, 93 fluid 97 is evacuated from between upper and lower elastomeric annular covers 91, 93. Consequently, one much less likely to create a "soft set" with the improved inflatable packing device of the present invention.

FIG. 6 is a view of the improved inflatable packing device 61 in a fully-inflated setting position. In this position, upper and lower anchor regions 85, 87 frictionally engage interior surface 101 of casing 99. Upper and lower anchor regions 85, 87 do not form a seal at the interface with the interior surface 101. Rather, upper and lower elastomeric annular covers 91, 93 serve to sealingly engage interior surface 101 of casing 99. As shown in FIG. 6, central area 103 between upper and lower elastomeric annular covers 91, 93 serves to evacuate fluid from between upper and lower elastomeric annular covers 91, 93. However, central area 103 does not serve to frictionally engage interior surface 101, and does not serve to form a seal with interior surface 101. In the preferred embodiment, central area 103 comprises a region of annular inflatable wall 79 which is between one and four inches in length, but could be substantially shorter or longer in length.

The present invention also includes an improved method of providing a seal between a conduit and an interior surface within a wellbore containing fluid. The steps include providing a cylindrical housing including upper and lower collar members. Next, an annular inflatable wall is disposed between the upper and lower collar members. Then, upper and lower spaced apart elastomeric annular covers are disposed over the annular inflatable wall, and define an upper anchor region of the annular inflatable wall, a lower anchor region of the annular inflatable wall, an intermediate region between upper and lower spaced apart elastomeric annular covers. The cylindrical housing is then coupled to a conduit, and lowered into a wellbore. Next, the annular inflatable wall is inflated with fluid causing the upper and lower anchor regions and intermediate region to move radially outward from a non-inflated running position to an inflated setting position. Inflation of the annular inflatable wall also causes the upper and lower anchor regions to expand evenly in opposition to the upper and lower spaced apart elastomeric covers, and to engage the interior surface to resist at least one of longitudinal and rotational movements. Inflation of the annular inflatable wall also causes the intermediate region to evacuate fluid from between the upper and lower spaced apart elastomeric covers. Finally, the upper and lower spaced apart elastomeric covers are caused to sealingly engage the interior surface to provide a double seal to fluid.

In this method, the intermediate region expands at a rate faster than the upper and lower spaced apart elastomeric covers, and thus comes into contact with the interior surface before the upper and lower spaced apart elastomeric covers come into contact with the interior surface.

The present invention has two distinct advantages over prior art inflatable packing devices. First, in the present invention, multi-dimensional strain, including tri-axial strain, on elastomeric covers of the packing device is minimized, diminishing the risk of damage to the packing device through tearing of the elastomeric covers. Second, the region of the annular inflatable wall between the upper and lower annular elastomeric covers expands at a rate sufficient to evacuate fluid from between the upper and lower annular elastomeric covers before they sealingly engage the interior surface in the wellbore. Consequently, the possibility of obtaining a "soft set" is minimized with the present invention.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. An inflatable packing device for use in a wellbore containing fluid for providing a seal between a conduit carrying the inflatable packing device and an interior surface within the wellbore, comprising:

a cylindrical housing;

means for securing said cylindrical housing to said conduit;

an annular inflatable wall secured to said cylindrical housing;

a cover disposed over a portion of said annular inflatable wall, including upper and lower sealing areas which partially resist radial expansion of said annular inflatable wall, and further including a central area between said upper and lower sealing areas which resists radial expansion of said annular inflatable wall in an amount less than the resistance of said upper and lower sealing areas;

said annular inflatable wall including at least one anchor region adjacent said cover, said at least one anchor region being located in a region other than between said upper and lower sealing areas of said cover;

said at least one anchor region being radially flexible between a non-inflated running position with said at least one anchor region out of contact with said interior surface and an inflated setting position with said at least one anchor region in contact with said interior surface; and wherein a portion of said annular inflatable wall underlying said central area of said cover is likewise radially flexible between a non-inflated running position and an inflated setting position to evacuate fluid between said stealing members to prevent fluid from being trapped between said upper and lower sealing areas and said interior surface.

2. An inflatable packing device according to claim 1, wherein said central area of said cover does not form a seal with said interior surface.

3. An inflatable packing device according to claim 1, wherein said at least one anchor region does not form a seal with said interior surface.

4. An inflatable packing device according to claim 1, wherein radial expansion of said annular inflatable wall at said central region minimizes multi-dimensional strain on said upper and lower sealing areas of said cover as said annular inflatable wall is expanded radially outward.

5. An inflatable packing device for use in a wellbore containing fluid, for providing a seal between a conduit carrying the inflatable packing device and an interior surface within the wellbore, comprising:

a cylindrical housing;

means for securing said cylindrical housing to said conduit;

an annular inflatable wall secured to said cylindrical housing;

a cylindrical cover disposed over a portion of said annular inflatable wall, including an annular gap separating said cylindrical cover into upper and lower sealing members;

said annular inflatable wall including at least one anchor region adjacent said cylindrical cover, said at least one anchor region being located in a region other than between said upper and lower sealing members;

said at least one anchor region being radially flexible between a non-inflated running position with said at least one anchor region out of contact with said interior surface, and an inflated setting position with said at least one anchor region in contact with said interior surface;

wherein a region of said annular inflatable wall underlying said gap is likewise radially flexible between a non-inflated running position and an inflated setting position to evacuate fluid between said sealing members to prevent fluid from being trapped between said upper and lower sealing members and said interior surface and to diminish multi-dimensional strain on said upper and lower sealing members.

6. An inflatable packing device according to claim 5, wherein said annular inflatable wall includes an inner elastomeric sleeve covered by an array of slats.

7. An inflatable packing device according to claim 5, wherein said region of said annular inflatable wall underlying said gap radially expands into contact with said interior surface when in said inflated setting position.

8. An inflatable packing device according to claim 5, wherein each of said sealing members of said cylindrical cover engage and form a fluid tight seal with said interior surface when in said inflated setting position.

9. An inflatable packing device according to claim 5, wherein said cylindrical cover is elastomeric and also serves to automatically retract said annular inflatable wall at deflation from said inflated setting position to said non-inflated running position.

10. An inflatable packing device according to claim 5, wherein said sealing members of said cylindrical cover are elastomeric members which partially resist inflation of said annular inflatable wall and ensure uniform inflation of said annular inflatable wall.

11. An inflatable packing device for use in a wellbore containing fluid, for providing a seal between a conduit carrying the inflatable packing device and an interior surface within the wellbore, comprising:

a cylindrical housing having a central longitudinal axis and including upper and lower collar members;

means for securing said cylindrical housing to said conduit;

an annular inflatable wall with upper and lower ends, said upper and lower ends secured to said upper and lower collar members respectively, with said annular inflatable wall disposed over at least a portion of said cylindrical housing;

said annular inflatable wall including an inner elastomeric sleeve covered by an array of movable slats;

upper and lower elastomeric annular covers axially spaced-apart relative to said central longitudinal axis and disposed over a portion of said annular inflatable wall between said upper and lower collar members of said cylindrical housing, in-part defining:

an upper anchor region of said annular inflatable wall between said upper collar and said first elastomeric annular cover;

a lower anchor region of said annular inflatable wall between said lower collar and said second elastomeric annular cover; and a central region of said annular inflatable wall between said first and second elastomeric annular covers;

said upper and lower anchor regions and said central region being outwardly movable from a non-inflated running position to an inflated setting position;

wherein said upper and lower anchor regions expand evenly in opposition to said upper and lower elastomeric annular covers and operate to frictionally engage said interior surface to resist at least one of longitudinal and rotational movements when in said inflated setting position;

wherein said central region operates to evacuate fluid from between said upper and lower elastomeric annular covers when expanded radially outward from said running position to said setting position; and wherein said upper and lower elastomeric annular covers operate to sealingly engage said interior surface and provide a double seal to fluid when expanded radially outward from said running position to said setting position.

12. An inflatable packing device according to claim 11, wherein said array of slats comprise a plurality of axially aligned and overlapping slats disposed in an annular array for accommodating radial outward expansion of said inner elastomeric sleeve.

13. An inflatable packing device according to claim 11, wherein said inner elastomeric tube comprises an elastomeric sleeve which is disposed between said cylindrical housing sand said array of slats.

14. An inflatable packing device according to claim 11, wherein said array of slats comprises a series of overlapping thin metal strips.

15. An inflatable packing device according to claim 11, wherein said array of slats comprise a plurality of axially aligned and overlapping slats disposed in an annular array for accommodating radial outward expansion of said inner elastomeric sleeve, and wherein said upper and lower annular covers further operate to allow uniform separation of said slats in said array of slats as said annular inflatable wall is radially expanded.

16. An inflatable packing device for use in a wellbore containing fluid, for providing a seal between a conduit carrying the inflatable packing device and an interior surface within the wellbore, comprising:

a cylindrical housing including upper and lower collar members;

means for securing said cylindrical housing to said conduit;

an annular inflatable wall with upper and lower ends, said upper and lower ends secured to said upper and lower collar members respectively, with said annular inflatable wall disposed over at least a portion of said cylindrical housing;

at least one pair of spaced apart elastomeric annular covers disposed over said annular inflatable wall between said upper and lower collar members of said cylindrical housing, defining:

(a) at least two anchor regions of said annular inflatable wall; and (b) at least one central region, each being disposed between each pair of spaced apart elastomeric annular covers;

said at least two anchor regions being outwardly flexibly movable from a non-inflated running position to an inflated setting position;

wherein said at least two anchor regions expand evenly in opposition to said at least one pair of spaced apart elastomeric covers and operate to frictionally engage said interior surface to resist at least one of longitudinal and rotational movements when in said inflated setting position;

wherein said at least one central region between each pair of spaced apart elastomeric annular covers expand radially outward at a rate which exceeds that of said at least two anchor regions and operate to evacuate fluid from between adjoining annular regions separated by each pair of spaced apart elastomeric annular covers when expanded radially outward from said running position and said setting position; and wherein said at least one pair of spaced apart elastomeric annular covers operate to sealingly engage said interior surface and provide multiple seals to fluid when expanded radially outward from said running position to said setting position.

17. An inflatable packing device for use in a wellbore according to claim 16, wherein said at least one central region between each pair of spaced apart elastomeric annular covers comes into contact with said interior surface before each adjoining pair of spaced apart elastomeric annular covers comes into contact with said interior surface.

18. A method of providing a seal between a conduit and an interior surface within a wellbore containing fluid, comprising:

providing a cylindrical housing including upper and lower collar members;

providing an annular inflatable wall disposed between said upper and lower collar members;

providing upper and lower spaced apart elastomeric annular covers disposed over said annular inflatable wall, defining at least one anchor region of said annular inflatable wall, and an intermediate region between said upper and lower spaced apart elastomeric annular covers, said at least one anchor region being disposed in a region other than between said upper and lower spaced apart elastomeric covers;

coupling said cylindrical housing to said conduit;

lowering said cylindrical housing into said wellbore;

inflating with fluid said annular inflatable wall causing:

(a) said at least one anchor region and said intermediate region to move radially outward from a non-inflated running position to an inflated setting position;

(b) said at least one anchor region to expand evenly in opposition to said upper and lower spaced apart elastomeric covers and engage said interior surface to resist at least one of longitudinal and rotational movements;

(c) said intermediate region to evacuate fluid from between said upper and lower spaced apart elastomeric covers; and (d) said upper and lower spaced apart elastomeric covers to sealing engage said interior surface and provide a double seal to fluid.

19. A method of providing a seal according to claim 18, wherein said intermediate region radially expands at a faster rate than said upper and lower spaced apart elastomeric covers, and comes into contact with said interior surface before said upper and lower spaced apart elastomeric covers.

* * * * *

UNITED STATES PATENT AND TRADEMARK OFFICE

CERTIFICATE OF CORRECTION

PATENT NO. : 5,101,908
DATED : April 7, 1992
INVENTOR(S) : Mody

It is certified that error appears in the above-indentified patent and that said Letters Patent is hereby corrected as shown below:

At column 8, line 34, delete "stealing" and insert -- sealing -- therefore.

At column 10, line 27, delete "sand" and insert -- and -- therefore.

Signed and Sealed this

Twenty-fifth Day of March, 1997

*Attest:*

Bruce Lehman

BRUCE LEHMAN

*Attesting Officer*

*Commissioner of Patents and Trademarks*